US005447347A

United States Patent [19]

Siddons

[11] Patent Number: 5,447,347

[45] Date of Patent: Sep. 5, 1995

[54] AUXILIARY DOOR STOP

[76] Inventor: Marcia Siddons, 6825 Haddington Rd., Cocoa, Fla. 32927

[21] Appl. No.: 263,366

[22] Filed: Jun. 20, 1994

[51] Int. Cl.[6] ..... E05C 17/50

[52] U.S. Cl. ..... 292/342; 292/DIG. 15; 292/DIG. 4; 292/336; 16/82

[58] Field of Search ..... 292/342, 338, DIG. 15, 292/209, 210, 336, 332, 334, DIG. 4, DIG. 26; 16/82, DIG. 10, 85

[56] References Cited

U.S. PATENT DOCUMENTS

| | | | |
|---|---|---|---|
| 398,889 | 3/1889 | Gehrung | 292/334 |
| 1,895,146 | 1/1933 | Brown | 292/336 |
| 3,330,585 | 7/1967 | Pollin | 292/DIG. 15 |
| 3,805,322 | 4/1974 | Serrano | 292/DIG. 15 |
| 3,833,963 | 9/1974 | Waters | 292/DIG. 15 |
| 4,114,936 | 9/1978 | Dominguez | 292/342 |
| 4,303,266 | 12/1981 | Volpi | 292/DIG. 15 |
| 4,501,444 | 2/1985 | Dominguez | 292/342 |
| 4,631,776 | 12/1986 | King | 292/DIG. 15 |
| 4,797,970 | 1/1989 | Charlton | 16/82 |

FOREIGN PATENT DOCUMENTS

| | | | |
|---|---|---|---|
| 1358603 | 7/1974 | United Kingdom | 292/DIG. 15 |

*Primary Examiner*—Peter M. Cuomo
*Assistant Examiner*—Darnell M. Boucher

[57] ABSTRACT

A door stop wedge is mounted into a receptacle recessed in the floor inside an inwardly-opening door. A detent keeps the wedge normally in an inoperative position within the receptacle and releasable by downward foot pressure on a tab connected to the locking arm for such detent. The wedge is spring-loaded to pop up into operating position when the detent is released. Foot pressure on the back of the wedge will cause it to retract into the receptacle and the detent to spring back into locking position.

4 Claims, 3 Drawing Sheets

AUXILIARY DOOR STOP

BACKGROUND OF THE INVENTION

1. Field of the Invention

The present invention relates to door stops and more particularly pertains to an internal door stop wedge which may be foot-operated.

2. Description of the Prior Art

The use of door stops is known in the prior art. More specifically, internal door stops heretofore devised and utilized for the purpose of auxiliary locks for a door are known to consist basically of familiar, expected and obvious structural configurations, notwithstanding the myriad of designs encompassed by the crowded prior art which have been developed for the fulfillment of countless objectives and requirements. Typical of such devices are shown in U.S. Pat. Nos. 5,120,093; 5,207,464; 5,199,759; 4,456,291; and 4,673,203. These constructions generally are cumbersome, unsightly, in the way when door is opened and/or require removal and require bending over to operate or to disengage.

In this respect, the door stop according to the present invention substantially departs from the conventional concepts and designs of the prior art, and in so doing provides an apparatus primarily developed for the purpose of ease of use and minimal effort to engage or disengage.

Therefore, it can be appreciated that there exists a continuing need for new and improved door stops. In this regard, the present invention substantially fulfills this need.

SUMMARY OF THE INVENTION

In view of the foregoing disadvantages inherent in the known types of door stops now present in the prior art, the present invention provides an improved door stop construction wherein the same can be utilized for affective and positive prevention of opening a door. As such, the general purpose of the present invention, which will be described subsequently in greater detail, is to provide a new and improved door stop apparatus which has all the advantages of the prior art stops and none of the disadvantages.

To attain this, the present invention essentially comprises a door stop wedge which is mounted into a receptacle recessed in the floor inside an inwardly-opening door. A detent keeps the wedge normally in an inoperative position within the receptacle and releasable by downward foot pressure on a tab connected to the locking arm for such detent. The wedge is springloaded to pop up into operating position when the detent is released. Foot pressure on the back of the wedge will cause it to retract into the receptacle and the detent to spring back into locking position.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved auxiliary door stop which has all the advantages of the prior art and none of the disadvantages.

It is another object of the present invention to provide a new and improved door stop which may be easily and efficiently manufactured and marketed.

It is a further object of the present invention to provide a new and improved auxiliary door stop which is of a durable and reliable construction.

An even further object of the present invention is to provide a new and improved door stop which is susceptible of a low cost of manufacture with regard to both materials and labor, and which accordingly is then susceptible of low prices of sale to the consuming public, thereby making such devices economically available to the buying public.

Still yet another object of the present invention is to provide a new and improved door stop which provides in the apparatuses of the prior art some of the advantages thereof, while simultaneously overcoming some of the disadvantages normally associated therewith.

Still another object of the present invention is to provide a new and improved auxiliary door stop which may be built-in to new construction or added to an existing structure.

Yet another object of the present invention is to provide a new and improved door stop which is fixed against movement by an intruder.

Even still another object of the present invention is to provide a new and improved door stop which stores in a completely out-of-the-way manner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
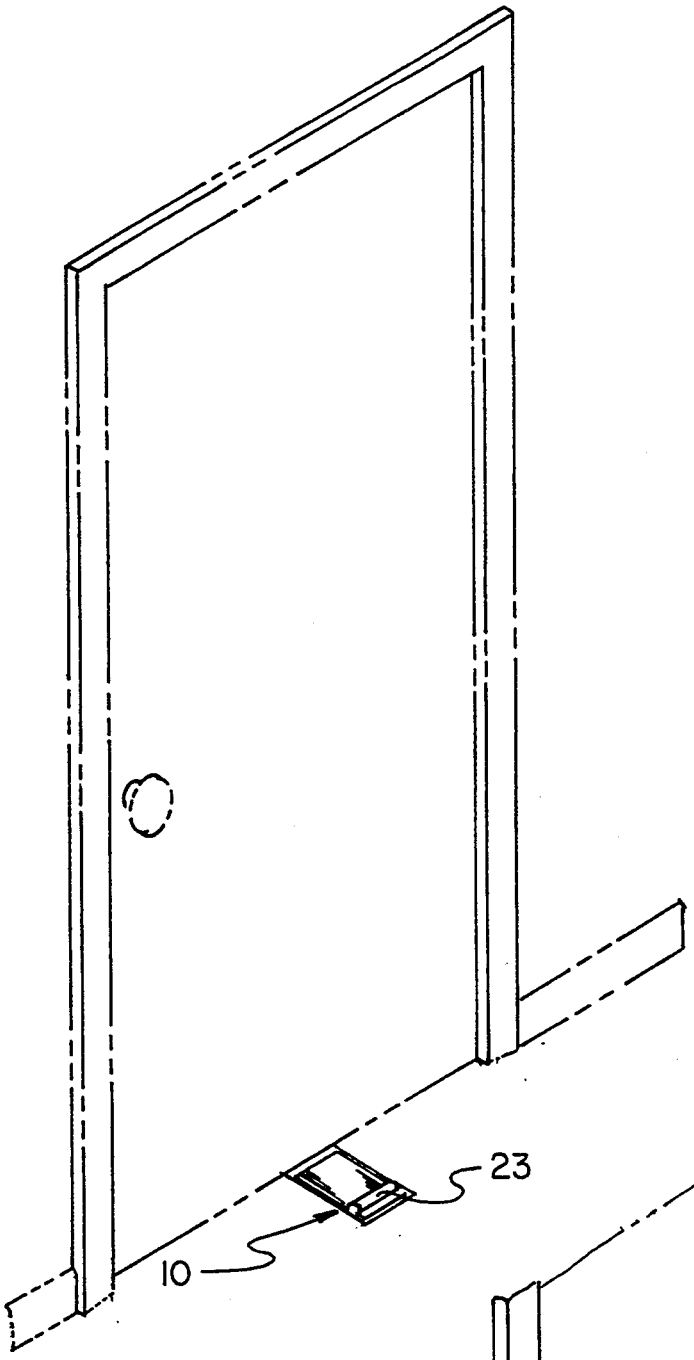
FIG. 1 is a perspective view of a conventional door with the door stop of the present invention in an inoperative position.

With reference now to the drawings, and in particular to FIG. 1 thereof, a new and improved auxiliary door stop embodying the principles and concepts of the present invention and generally designated by the reference numeral 10 will be described.

Figure 2:
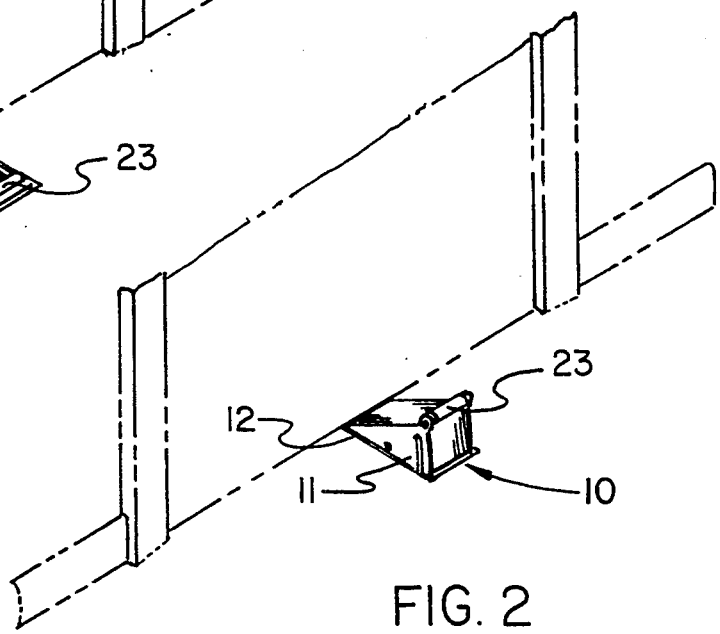
FIG. 2 is a similar view to that of FIG. 1 showing the door stop of the present invention in operative position.

More specifically, it will be noted that the wedge door stop 10 of the present invention, when not in use, recesses into the floor as shown in FIG. 1, immediately in front of an inwardly opening conventional door, and does not require unsightly attachments of any kind to the door itself. As shown in FIG. 2, the wedge portion 11 of unit 10 is a hollow rigid unit tapering up to a curved rear section 21 and such wedge portion 11 pops up out of the floor and into position with the tapered end 12 thereof in engagement with the door should an attempt be made to open such door. Wedge 11 is fixed by a locking plate 18 to its receptacle 13 (as shown in subsequent drawings) against any inward movement as a result of force applied to the door.

Figure 3:
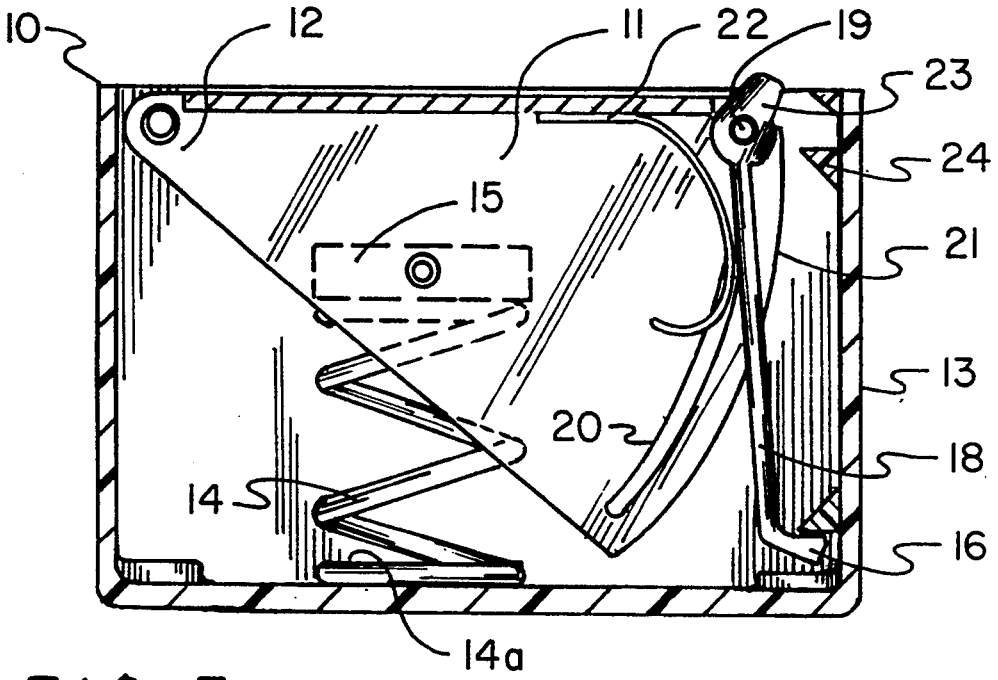
FIG. 3 is a side elevation view of the present invention in its inoperative or stored position.
Figure 4:
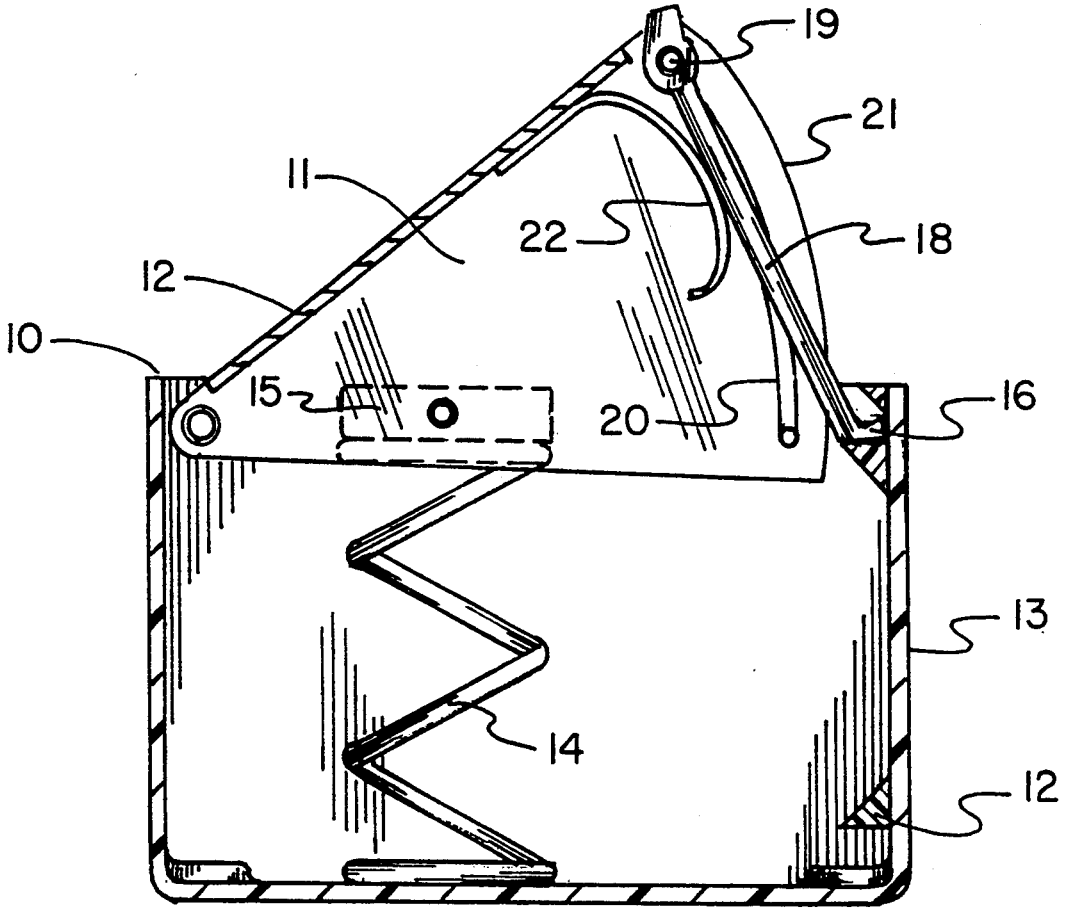
FIG. 4 is a side elevation of the present invention in the operative position.

As shown in FIGS. 3 and 4 the wedge 11 is normally encased within a receptacle 13 recessed in the floor in front of the door. The hollow wedge 12 is spring-loaded by means of a compression spring 14 engaging with a raised boss 14A on the base of receptacle 13 at one end and with a pivoted spring stop plate 15 affixed within the interior of wedge 12 at the other end. Wedge 12 is thus normally urged upwardly into the operative position by such spring 14 and is restrained against such upward movement by engagement of a detent 16 with a stop member 17 formed within as a part of receptacle 13 or affixed to the wall thereof. Detent 16 is formed at the end of an operating plate or locking plate 18 which is affixed to wedge 12 and is moveable with respect thereto by a pivot pin 19 sliding within a curved groove or track 20 formed in wedge 12. Track 20 is inset into the side of wedge 12 and its curvature parallels that of the inner end 21 of wedge 12. A single leaf spring 22 is affixed to the surface of wedge 12 and bears against locking plate 18, normally forcing detent 16 into engagement with stop member 17. It will be noted that pressure exerted downwardly on the upper end of locking plate 18 by stepping on the protruding end 23 thereof will cause the pin 19 to move a slight distance down track 20 freeing detent 16 from stop member 17 and allowing wedge 11 to be forced upwardly by spring 14 when such pressure is released from locking plate 18.

As wedge 11 rises, pivot pin 19 slides within track 20. When detent 16 reaches the top of receptacle 13, it slides up and over stop member 24 and snaps into place under the urging of leaf spring 22. In this open or operating position force exerted against the tapered end 12 of wedge 11 will be directly transmitted to locking plate 18 thence to stop member 24 and the receptacle 13 sunk into the floor. Since the entire unit 10 is preferably made of steel or similar rigid, unyielding material, continued inward pressure on wedge 11 will not permit the door (which is exerting such pressure) to be opened. However, pressure applied to the protruding end 23 of locking plate 18 will again cause detent 16 to disengage and wedge 11 to be moved into its storage position within receptacle 13. Releasing such pressure when wedge 11 is fully in its closed position will cause plate 18 to pivot, driving detent 16 into engagement with stop member 17 and leaving the unit 10 locked into the inoperative or storage position within receptacle 13.

Figures 5, 6:
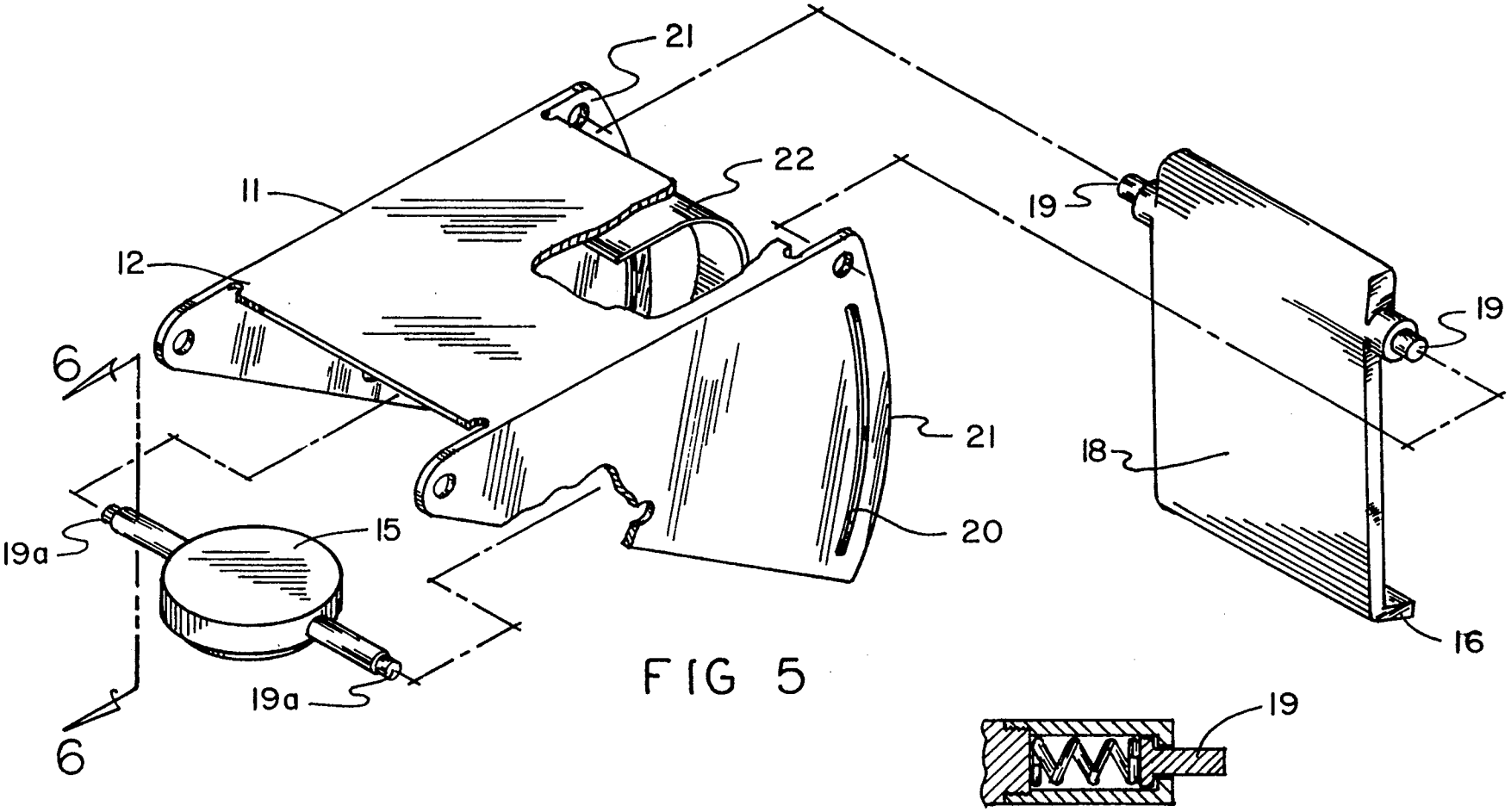
FIG. 5 is an exploded perspective partial view showing the elements of the wedge portion of the present invention in detail.
FIG. 6 is a sectional view on line 6—6 of FIG. 5.

FIG. 5 is a partial exploded view of the wedge portion 11 illustrating in greater detail the components thereof including the tapered end 12; the curved rear section 21 carrying the curved track opening 20; the leaf spring 22; locking plate 18 with its detent member 16; and the pivoted spring stop plate 15. This view illustrates that the spring stop plate 15 is circular (of larger diameter than spring 14 with which it engages) and has a lower circular portion which fits within the coil of spring 14 to give positive anchorage thereto.

FIG. 6 shows that pivot pin 19 and also the pins 19A on spring stop plate 15 are spring-loaded to permit the locking plate 18 and spring stop plate 15 to be snapped into place on wedge member 11.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A door stop device which comprises: a hollow, rigid, wedge member pivotally mounted to a receptacle which is arranged to be recessed into a floor in front of a door with which such door stop is to be used; compression spring means within said receptacle for normally urging said wedge member upwardly therefrom; a locking plate having a base and a top with the locking plate pivotally secured on a rear of said wedge member by a pivot pin; a detent carried by the base of said locking plate; means within said receptacle to engage said detent and to retain said wedge within said receptacle; and means to disengage said detent by downward foot pressure on the top of said locking plate to cause said wedge member to be urged upwardly from within said receptacle; said means to disengage said detent comprises a raised upper end on said locking plate extending above the wedge member and arranged to engage said wedge member receptacle adjacent said locking plate and forming the means to engage said detent on, whereby downward pressure on said raised upper end of said locking plate causes said detent to release from engagement with said means within said receptacle to engage said detent.

2. A device as in claim 1 wherein said compression spring means comprises a coiled tubular compression spring engaging at one end with said receptacle and a pivoted spring stop plate mounted within said hollow wedge portion engaging with the other end of said compression spring.

3. A device as in claim 1 wherein a leaf spring member is mounted within said wedge member in engagement with said locking plate to cause said detent to move against the rear wall of said receptacle when downward pressure on the raised upper end of said locking plate is released.

4. A door stop device which comprises: a hollow, rigid, wedge member pivotally mounted to a receptacle which is arranged to be recessed into a floor in front of a door with which such door stop is to be used; compression spring means within said receptacle for normally urging said wedge member upwardly therefrom; a locking plate having a base and top with the locking plate pivotally secured to a rear of said wedge member adjacent the top; a detent carried by the base of said locking plate; means within said receptacle to engage said detent and to retain said wedge within said receptacle; and means to disengage said detent by downward foot pressure on the top of said locking plate to cause said wedge member to be urged upwardly from within said receptacle; said locking plate is mounted with a pivot pin extending therethrough; said wedge member further having two curved track openings, said pivot pin extending within and riding on said curved track openings; a raised upper end on said locking plate extending above said wedge member; a stop member on a rear wall of said receptacle adjacent said locking plate and forming the means to engage said detent on the base of said locking plate, whereby downward pressure on said raised upper end of said locking plate causes said pivot pin to ride down said track openings and the curvature of said openings causes said detent to release from engagement with said stop member.

* * * * *